US009162841B2

(12) United States Patent
Dunham et al.

(10) Patent No.: US 9,162,841 B2
(45) Date of Patent: Oct. 20, 2015

(54) METHOD AND APPARATUS FOR COMBINING ONE OR MORE OF TAMPING A STACK OF SUBSTRATES, LATERALLY OFFSETTING A SUBSTRATE, AND ACTUATING OTHER MECHANISMS USEFUL IN PRINTING IN AN IMAGE FORMING DEVICE

(71) Applicant: XEROX Corporation, Norwalk, CT (US)

(72) Inventors: Brian J. Dunham, Webster, NY (US); Carlos Manuel Terrero, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 218 days.

(21) Appl. No.: 13/927,059

(22) Filed: Jun. 25, 2013

(65) Prior Publication Data

US 2014/0373781 A1 Dec. 25, 2014

(51) Int. Cl.

| | |
|---|---|
| ***B65H 31/20*** | (2006.01) |
| ***B65H 31/26*** | (2006.01) |
| ***B65H 31/34*** | (2006.01) |
| ***B65H 31/38*** | (2006.01) |
| ***B65H 33/08*** | (2006.01) |

(52) U.S. Cl.

CPC ..... *B65H 31/20* (2013.01); *B65H 31/26* (2013.01); *B65H 31/34* (2013.01); *B65H 31/38* (2013.01); *B65H 33/08* (2013.01); *B65H 2301/4219* (2013.01); *B65H 2301/4222* (2013.01)

(58) Field of Classification Search

CPC ..... B65H 31/20; B65H 31/26; B65H 31/34; B65H 31/38; B65H 33/08; B65H 2301/421; B65H 2301/4219; B65H 2301/4222

USPC ..... 271/220, 221; 414/788.9, 789.1, 791.2

See application file for complete search history.

(56) References Cited

U.S. PATENT DOCUMENTS

| | | | | |
|---|---|---|---|---|
| 3,951,264 | A * | 4/1976 | Heidecker et al. | 206/308.3 |
| 2009/0236798 | A1* | 9/2009 | Kimura et al. | 271/221 |
| 2010/0044958 | A1* | 2/2010 | Tomida | 271/234 |
| 2012/0299239 | A1* | 11/2012 | Wang et al. | 271/227 |
| 2013/0285313 | A1* | 10/2013 | Iwata | 271/220 |

* cited by examiner

*Primary Examiner* — David H Bollinger

(74) *Attorney, Agent, or Firm* — Ronald E. Prass, Jr.; Prass LLP

(57) ABSTRACT

An approach is provided to cause an operation comprising one or more of a substrate tamping process, a substrate offset process, and a mechanism actuation process. The approach involves determining an instruction to cause the operation. The approach also involves causing a movement of one or more of a slide element and a shaft based on the instruction. The slide element and the shaft are configured to move in a first direction and a second direction along a length of the shaft. The movement in the first direction and the second direction of one or more of the slide element and the shaft corresponds to the operation.

16 Claims, 6 Drawing Sheets

METHOD AND APPARATUS FOR COMBINING ONE OR MORE OF TAMPING A STACK OF SUBSTRATES, LATERALLY OFFSETTING A SUBSTRATE, AND ACTUATING OTHER MECHANISMS USEFUL IN PRINTING IN AN IMAGE FORMING DEVICE

FIELD OF DISCLOSURE

The disclosure relates to a method and a simplified system to provide a sliding mechanism for implementing a plurality of functions including tamping a stack of substrates, laterally offsetting one or more substrates in a transport path, and actuating other mechanisms that may be useful in controlling the transport of substrates through a transport path in an image forming device.

BACKGROUND

Printing systems in modern image forming devices often provide multiple separate mechanisms that are configured to individually perform tasks associated with, for example, alignment of single and multiple substrates in the image forming devices. These individually-implemented tasks include separate mechanisms for tamping a stack of substrates, for laterally offsetting one or more substrates, and for actuating other mechanisms that are otherwise useful in control of substrate movement through the image forming device. The other mechanisms may include actuating certain latching mechanisms for locking and unlocking components associated with the movement of substrates out of the image forming devices. Image forming device manufacturers are continually challenged to reduce the overall space occupied by various multi-component or multi-function printing systems, without increasing complexity or cost.

SUMMARY

It may be advantageous to provide an approach to implement a simple sliding mechanism that may control a plurality of the functions previously controlled by multiple, and perhaps redundant, components in an image forming device including at least tamping a stack of substrates, laterally offsetting one or more substrates in a transport path, and actuating another mechanism useful in substrate transport in support of printing in the image forming device.

According to one embodiment, a method useful in printing comprises determining an instruction to cause an operation comprising one or more of a substrate tamping process, a substrate offset process, and a mechanism actuation process. The method also comprises causing a movement of one or more of a slide elements and one or more shafts based on the instruction, the slide elements and the shafts being configured to move in a first direction and a second direction along a length of the one or more shafts. The movement in the first direction and the second direction of one or more of the slide elements and the one or more shafts corresponds to the operation.

According to another embodiment, an apparatus useful in printing comprises a physical structure and at least one processor, the processor being programmed to determine an instruction to cause an operation comprising one or more of a substrate tamping process, a substrate offset process, and a mechanism actuation process. The apparatus being configured to promote movement of one or more slide elements and one or more shafts based on the instruction, the one or more slide elements and the one or more shafts being configured to move in a first direction and a second direction along a length of the one or more shafts. The movement in the first direction and the second direction of one or more slide element and the one or more shafts corresponds to the operation.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing a simplified structure for substrate handling in an image forming device will be described, in detail, with reference to the following drawings, in which.

DETAILED DESCRIPTION

Figure 1:
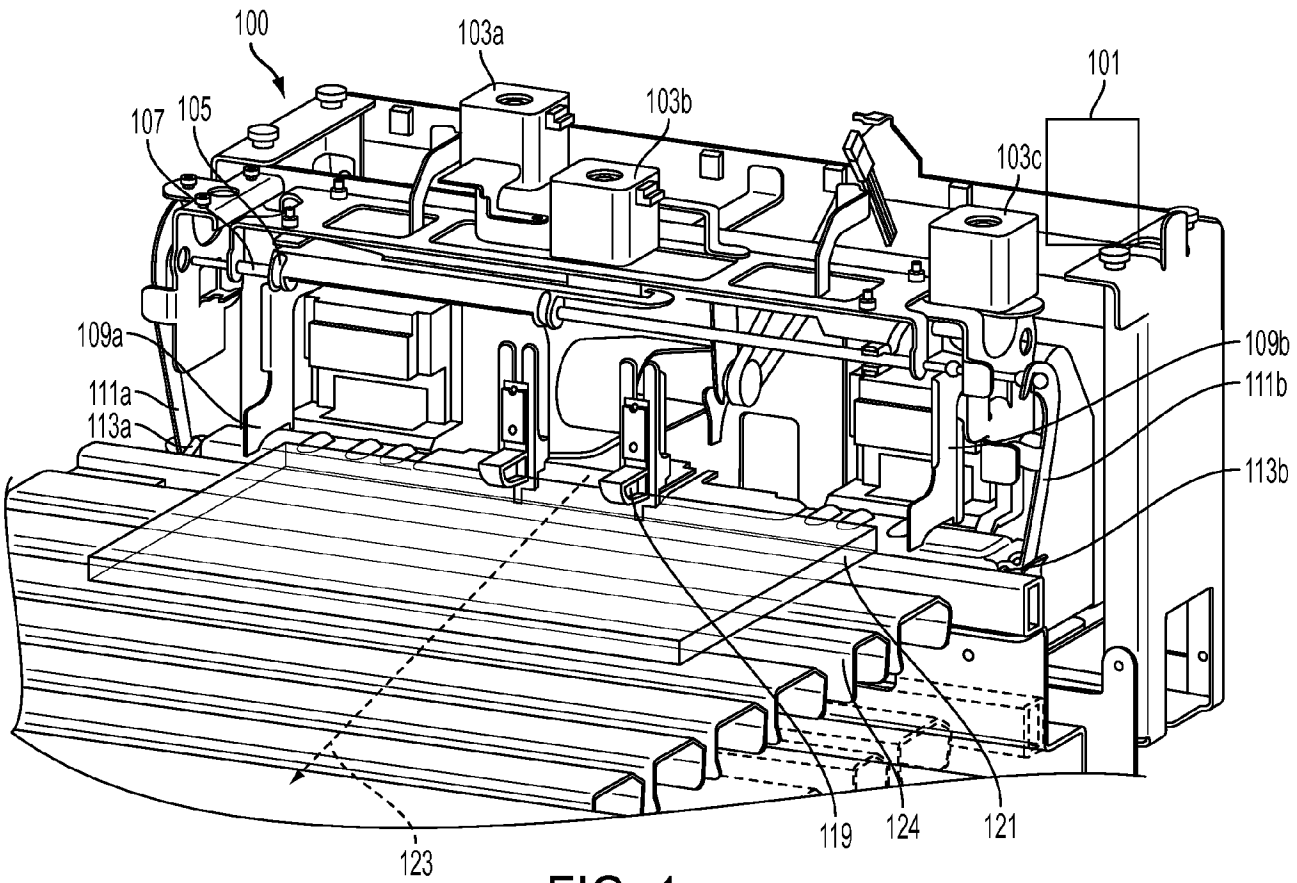
FIG. 1 illustrates an exemplary overview of the components of a system for combining a plurality of media handling functions, including tamping a stack of substrates, laterally offsetting a substrate, and/or actuating another mechanism useful in printing, according to this disclosure.

The systems and methods for implementing a simplified structure for substrate handling in an image forming device will generally refer to this specific utility or function for those systems and methods. Exemplary embodiments described and depicted in this disclosure should not be interpreted as being specifically limited to any particular configuration of the described elements, or as being specifically directed to any particular combination of the disclosed intended uses, including being limited in applicability to any particular functioning or operation of a processing, post-processing or other component device in an image forming system. Any advantageous combination of schemes that may employ a particular structure or scheme for implementing multiple substrate handling functions according to the generally-disclosed concepts are contemplated as being encompassed by this disclosure.

Specific reference to, for example, various configurations of image forming systems and component devices within those systems, including post-processors and/or finishers, as those concepts and related terms are captured and used throughout this disclosure, should not be considered as limiting those concepts or terms to any particular configuration of the respective devices, the system configurations or individual elements. The subject matter of this disclosure is intended to broadly encompass systems, devices, schemes and elements that may involve image forming and finishing operations as those operations would be familiar to those of skill in the art. The disclosed concepts are particularly adapted to selectable image receiving media handling operations in small image forming systems, and multi-function devices, as those concepts are understood by those of skill in the imaging and image forming arts.

The disclosed schemes may particularly address issues that arise in many different forms of reduced size devices in which device manufacturers seek to reduce numbers of redundant or nearly-redundant components in a manner that simplifies component structures leading to reductions in overall component or system size.

Examples of a method, apparatus, and computer program for combining a plurality of media handling functions, including tamping a stack of substrates, laterally offsetting a substrate, and/or actuating another mechanism useful in printing, are disclosed. In the following description, for the purposes of explanation, numerous specific details are set forth in order to provide a thorough understanding of the particularly-disclosed embodiments. It will be apparent, however, to one skilled in the art that the particularly-disclosed embodiments may be practiced without all of the specific details, or with substantially equivalent arrangements. In instances, well-known structures and devices are shown in block diagram form in order to avoid unnecessarily obscuring the embodiments.

As used in this disclosure, the term "slide element(s)" will generally refer to any mechanical component capable of sliding or being caused to slide along a length of a shaft. For example, such a mechanical component may itself be a bearing, comprise a bearing, or be an apparatus that comprises multiple components that include a bearing, or that may be otherwise slidable along the shaft based on any mechanism that may reduce friction between the slide element and the shaft.

FIG. 1 illustrates an exemplary overview of the components of a system 100 for combining a plurality of media handling functions, including tamping a stack of substrates, laterally offsetting a substrate, and/or actuating another mechanism useful in printing, according to this disclosure. The system 100 may be incorporated into, or attached to an output end of, an image forming system or device, including a post-processing device known as a finisher. The finisher may be configured to deliver single stacked sheets and/or to form a staple on a sheeted substrate comprising any material upon which a printed image may be formed. Conventional image forming systems that are configured to tamp a stack of substrates, laterally offset a substrate, and/or actuate another mechanism are often complex in nature because such conventional systems employ several different, and often redundantly-configured, mechanisms for causing any or each of the tamping, offsetting and/or actuating. The several mechanisms often require additional space within, or around, a conventional printing system, and accordingly increase the overall space occupied by the conventional system, as well as increasing the overall complexity and cost of the conventional printing system.

To address this problem, a system 100 as shown in FIG. 1 introduces the capability to provide multiple functionalities such as tamping a stack of substrates, laterally offsetting one or more substrates, and/or actuating another mechanism in a small envelope by reducing the numbers of mechanisms and of various parts that are conventionally necessary to perform these separate tasks. Accordingly, the system 100 includes an apparatus having a pair of slider shafts (see element 107) and at least a pair of corresponding slide elements (see element 105). The slide elements are configured to slide between corresponding first positions and corresponding second positions in opposite directions from one another, or in a same direction as one another, on demand and as directed by instructions from a controller 101 to one or more motors 103*a*, 103*b*, 103*c*. The slide elements may have respectively associated with them individual paddles 109*a*, 109*b* for manipulating substrates translating the relative movement of the slide elements to the substrates.

Additionally, the slide elements may be configured to remain in a corresponding predetermined position, or to move to a corresponding predetermined position, while the slider shafts themselves are moved between their own corresponding first and second positions. In some embodiments, the slider shafts may slide relative to the slide elements, for example, to actuate additional mechanisms 113*a*, 113*b*, such as a baffle latch mechanism, that may accordingly be caused to move between an engaged position and a disengaged position on demand through actuation of one or more of a pair of levers 111*a*, 111*b* for translating shaft movement to the actuators.

In embodiments, the slide elements may be a part of a multi-component apparatus that includes the paddles configured to tamp and/or offset a substrate that is processed by the system 100. For example, as one or more sheets of substrate material are output by a printing system that forms an image on the substrate, the sheeted substrate may be stacked on an output tray 124. The stack of sheeted materials is sometimes tamped to tidy the stack, and/or one or more sheets are sometimes caused to be offset from other sheets in the stack or for precise alignment with the stacks. Accordingly, slide elements associated with paddles may be caused to move in-and-out in opposite directions with respect to a centerline of an ejection direction 123 of the substrate from the system 100 to provide tamping to stacked sheets, or if offsetting is enabled, the slide elements associated with the paddles may first be aligned with an incoming sheet position and caused to move in a same direction to the respective incoming sheet location.

For review, in FIG. 1, the system 100 comprises a controller 101, motors 103*a*, 103*b*, 103*c* (collectively referred to hereinafter as motors 103), slide elements (depicted in FIG. 1 as a single slide element 105), shafts (depicted in FIG. 1 as a single shaft 1070, paddles 109*a*, 109*b* (collectively referred to hereinafter as paddles 109), levers 111*a*, 111*b* (collectively referred to hereinafter as levers 111), actuators 113*a*, 113*b* (collectively referred to hereinafter as actuators 113), and a tray, depicted in FIG. 1 as an elevator tray 124 movable between, for example, an "UP" position and a "DOWN" position.

According to various embodiments, the system 100, as discussed above, may be configured to be incorporated into a stapler module (not shown). Alternatively, the system 100 may be attached to an output end ejector 119 of the stapler module. The stapler module may be configured to form a staple on a substrate 121. The substrate 121 is output by the stapler module at the output end ejector 119 and stacked as additional sheets of substrate 121 are output by the stapler module and fed to the elevator tray 124 in the ejection direction 123 individually or as a stapled stack of sheeted substrate 121.

In embodiments, the controller 101 determines an instruction to cause an operation comprising a plurality of a substrate tamping process, a substrate offset process, and/or a mechanism actuation process. Accordingly, the controller 101 may actuate one or more of the motors 103 to cause a movement of one or more of the slide element(s) 105 and/or at least one of the shaft(s) 107 based on the instruction. The slide element(s) 105 and the shaft(s) 107 may be configured to move in either of a first direction or a second direction one or the other with respect to each other.

For example, as will be described in detail below with reference to FIGS. 3-5, a first slide element may be configured to slide along a length of corresponding first shaft, and a second slide element may be configured to slide along a length of corresponding second shaft. Shaft(s) 107 may also be configured to slide in a direction corresponding to their respective lengths in the first direction and the second direction while corresponding slide element(s) 105 either remain in a first position or are slid to a predetermined second position that may correspond to a degree of movement of the shaft(s) 107, or be an entirely different degree of movement. The first and second directions of movement may be considered to be toward and away from a centreline of the ejection direction 123, respectively.

The movement in the first direction and the second direction of one or more of the slide element(s) 105 and the shaft(s) 107 corresponds to the instructed operation. For example, if a substrate tamping process is instructed, the controller 101 may cause the slide element(s) 105 to move in opposing directions toward or away from one another. By contrast, if a substrate lateral offset process is instructed, the controller 101 may cause the slide element(s) 105 to move in a same direction in concert with one another. Alternatively, if a mechanism actuation process is instructed, the controller 101 may cause the shaft(s) 107 to move in a direction that may actuate a lever to, in turn, translate a shaft movement in a manner that actuates a mechanism, such as a latching mechanism.

In embodiments, the movement of the shaft(s) 107 discussed above may, in some detail, cause corresponding levers 111*a*, 111*b* to move latches 113*a*, 113*b* between respective engaged and disengaged positions. Such movement of the latches 113*a*, 113*b* may be used, for example, to attach and/or detach the system 100, in whole or in part from an output tray, a guide member, or a portion of the finisher and/or associated stapler module. In the example shown in FIG. 1, the levers 111*a*, 111*b* may be hinged such that a movement of one end of the levers 111*a*, 111*b* in the first direction, for example, may cause another end of the levers 111*a*, 111*b* to move in the second direction, and vice versa. It should be noted, however, that the mechanism actuation process should not be limited to requiring the levers 111*a*, 111*b* to move in this manner. Rather, movement of the shaft(s) 107 may be used to cause any form of actuation or movement of another component of the system 100, finisher or stapler module, for example.

According to various exemplary embodiments, the movement of the slide element(s) 105 and the shaft(s) 107 are further caused by at least one of the motors 103. For example, a single one of the motors 103 may be configured to control movement of any combination of the slide element(s) 105 and the shaft(s) 107, as instructed by the controller 101 in any combination of the first direction and the second direction based on the instructed operation. Alternatively, the movement of the slide element(s) 105 and the shaft(s) 107 may be caused by a series of specifically configured ones of the motors 103, which may be independently designated and/or operated as, for example, a tamping motor 103*a*, an offset motor 103*b*, and an actuator motor 103*c* that correspond to a particular one of the instructed operations.

In embodiments, the tamping motor 103*a* may be configured to cause the slide element(s) 105 to move in the first direction and in the second direction to perform an as-instructed tamping process. If a substrate tamping operation is instructed, the tamping motor 103*a* may cause the slide element(s) 105 to move in the first direction and in the second direction, opposite the first direction. During the tamping process, the slide element(s) 105 may also be moved by the tamping motor 103*a* in the second direction and in the first direction, opposite the second direction. In other words, the slide element(s) 105 are moved back and forth in opposite directions to tamp the stack of substrates 121.

In embodiments, the offset motor 103*b* may be configured to cause the slide element(s) 105 to move cooperatively in the first direction or separately to move cooperatively in the second direction to perform an instructed substrate offset process. If a substrate offset operation is instructed, the offset motor 103*b* may cause the slide element(s) 105 to move cooperatively and together in the first direction, i.e. in the same direction. In other words, the slide element(s) 105 are moved back and forth in a same direction together to offset the substrate 121.

In embodiments, the actuator motor 103*c* may be configured to cause the shaft(s) 107 to move in the first direction and in the second direction to perform an instructed mechanism actuation process. If a mechanism actuation operation is instructed, the actuator motor 103*c* causes the shaft(s) 107 to move in the first direction and in the second direction, opposite the first direction. During the mechanism actuation process, the shaft(s) 107 may also be moved by the actuator motor 103*c* in the second direction and in the first direction, opposite the second direction as needed to return the shaft(s) 107 to an initial starting position in which the shaft(s) 107 were before the mechanism actuation process commenced.

According to various embodiments, the slide element(s) 105 may be connected with corresponding paddles 109*a*, 109*b*. As one or more sheets of substrate 121 are output by the printing system, the paddles 109*a*, 109*b* may cause a position of the sheeted substrate 121 to change with respect to the centerline of the ejection direction 123. Accordingly, if a sheet of substrate 121 is output at the output end ejector 119 of the printing system, the paddles 109*a*, 109*b* may cause the sheet of substrate 121 to be aligned with the centerline of the ejection direction 123, or offset from the centerline of the ejection direction 123. Movement of the paddles 109*a*, 109*b* are configured to correspond with the movement of the slide element(s) 105 because, as discussed above, the slide element(s) 105 may be a part of the paddles 109*a*, 109*b* themselves, or one component of a multi-component apparatus that includes one of the paddle(s) 109*a*, 109*b* and a respective one of the slide element(s) 105.

Figure 2:
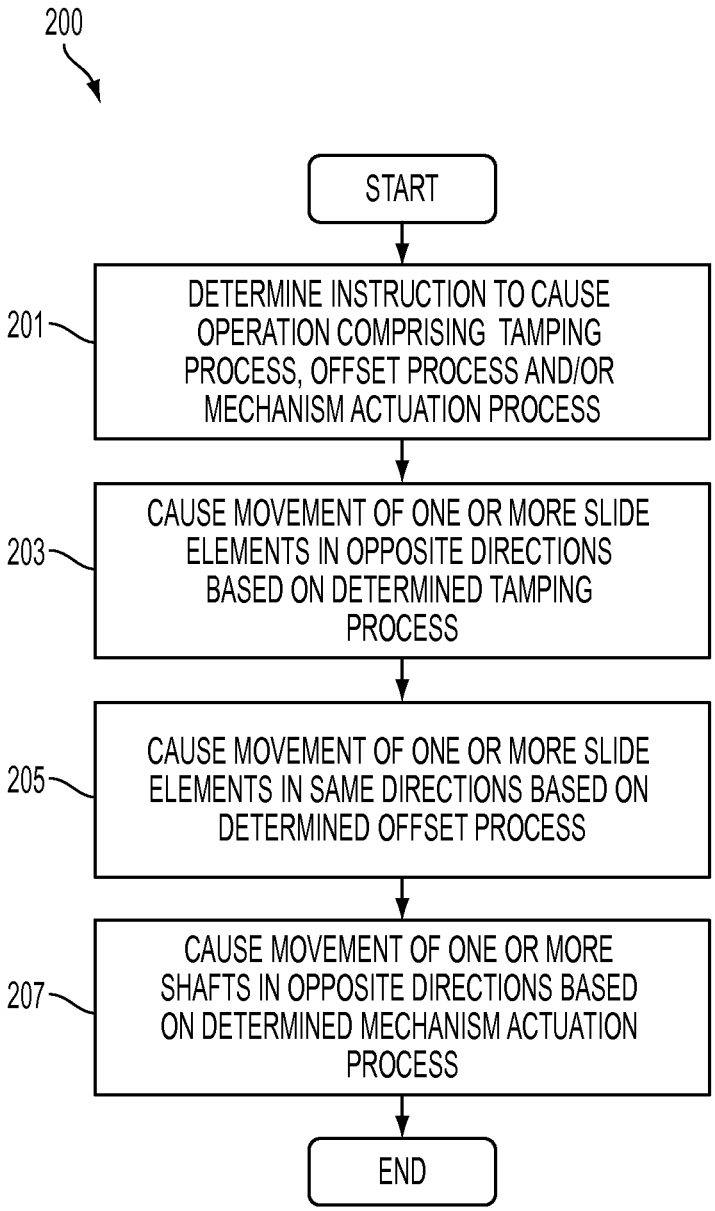
FIG. 2 is a flowchart of an exemplary process for combining a plurality of media handling functions, including tamping a stack of substrates, laterally offsetting a substrate, and/or actuating another mechanism useful in printing, according to this disclosure.
Figure 6:
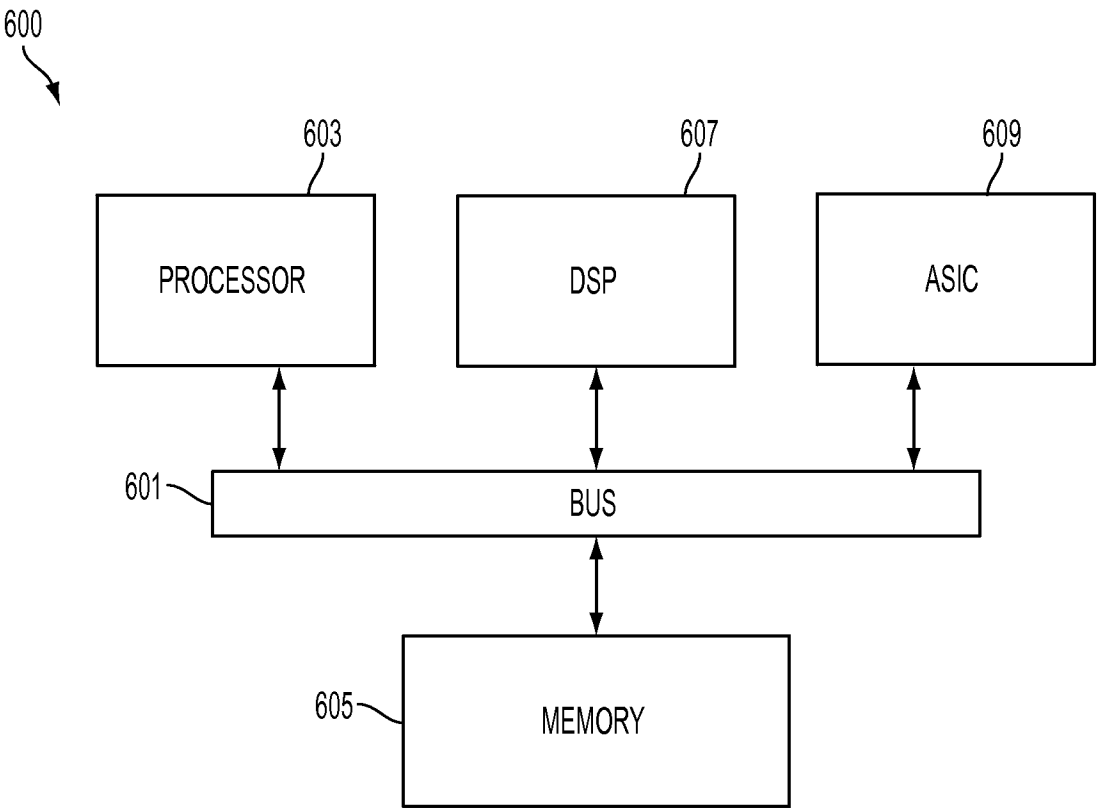
FIG. 6 is an exemplary block diagram of a control system, including a chip set, that can be used to implement a control scheme according to this disclosure.

FIG. 2 is a flowchart of a process for implementing a plurality of the one or more of tamping a stack of substrates, laterally offsetting a substrate, and actuating another mechanism useful in printing. In one embodiment, the controller 101 performs the process 200 implemented in, for example, a chip set including a processor and a memory as shown in FIG. 6. In step 201, the controller 101 may determine an instruction to cause an operation comprising one or more of a substrate tamping process, a substrate offset process, and a mechanism actuation process.

Then, in step 203, the controller 101 may cause a movement of a first slide element and a second slide element in opposite directions based on the instruction, the slide element(s) being configured to move in a first direction and a second direction along lengths of respective shafts. The movement in the first direction and the second direction of the slide element(s) corresponds to the operation. For example, if a tamping process is instructed, the controller 101 may cause the slide element(s) to move in the first direction and in the second direction based on the instructed substrate tamping process. Any movement of the slide element(s) in the instructed substrate tamping process may be caused by one or more motors that may include, for example, a tamping motor or motors.

Next, in step 205, the controller 101 may cause movement of a slide element and another slide element in a same direction based on the instruction, the slide element(s) being configured to move in a first direction and a second direction along lengths of respective shafts. The movement in the first direction and the second direction of the slide element(s) corresponds to the operation. For example, if an offset process is instructed, the controller 101 may cause the slide element to move in the first direction and the another slide element to also move in the first direction based on the determined substrate offset process. Any movement of the slide element(s) in an offset process may be caused by one or more motors that may include, for example, an offset motor or motors.

The process continues to step 207, in which the controller 101 may cause a movement of a shaft and of another shaft in opposite directions based on the instruction, the shaft(s) being configured to move in a first direction and a second direction along a respective length of the shaft(s). The movement in the first direction and the second direction of the shaft(s) corresponds to the operation. For example, if a mechanism actuation process is instructed, the controller 101 may cause the shaft to move in the first direction and the another shaft to move in the second direction based on the determined mechanism actuation process. Any movement of the shaft(s) in a mechanism actuation process may be caused by one or more motors that may include, for example, an actuator motor or motors.

In the mechanism actuation process, the controller 101, by way of moving the shafts, may additionally cause one or more lever(s) configured to interact with one or more of the shaft and the another shaft to move actuator(s), to which the lever(s) may be mechanically or operationally connected, between an engaged and a disengaged position based on at least one of the movement of the shaft and the movement of the another shaft. The actuator(s) may comprise latche(s), as discussed above, which may be configured to move between the engaged and the disengaged position to enable a tray to be attached to, detached from, or moved with respect to a system.

Figure 3:
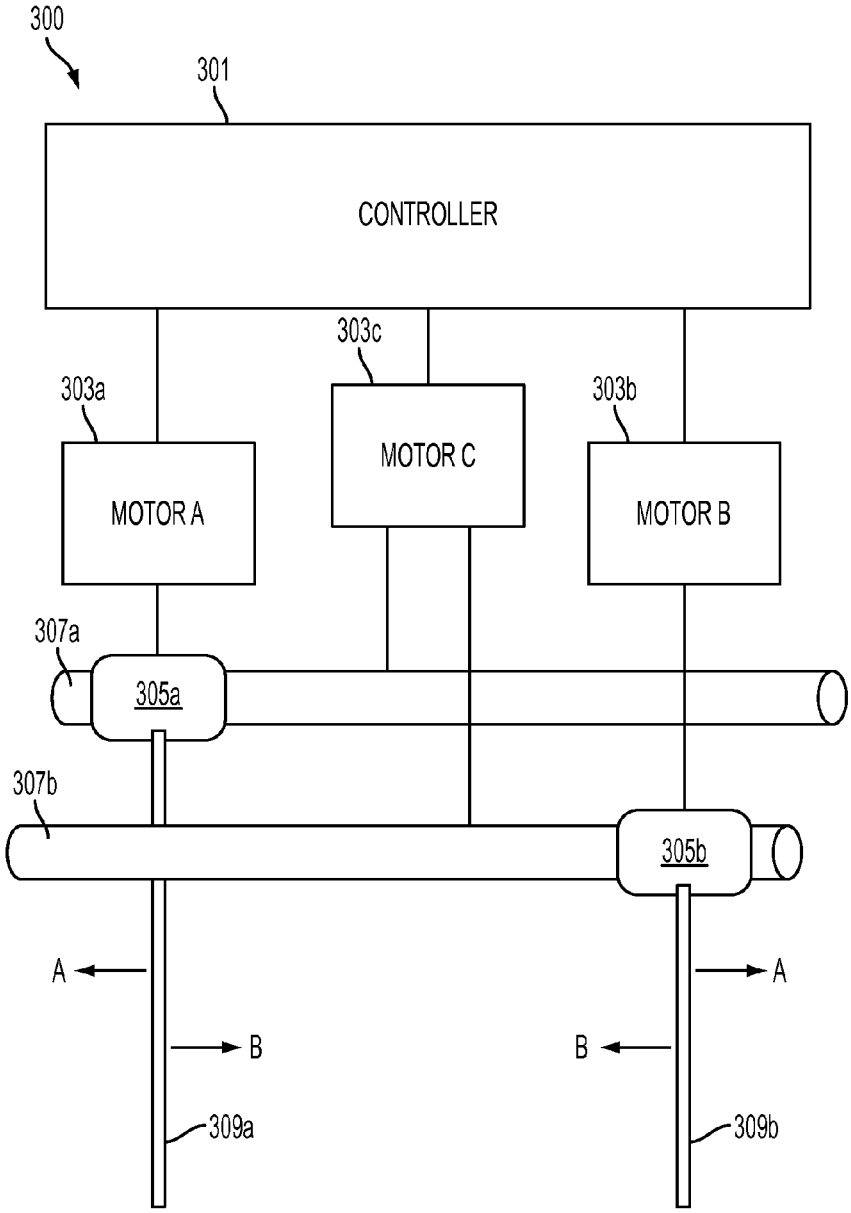
FIG. 3 illustrates a schematic diagram of a first exemplary movement of system components for tamping a stack of substrates in an image forming device according to this disclosure.

FIG. 3 illustrates a schematic diagram 300 of a first exemplary movement of system components for tamping a stack of substrates according to this disclosure. A numbering scheme will be employed in FIGS. 3-5 that is common to the numbering scheme shown in FIG. 1 in order to facilitate comparison of the details of the schematic diagrams shown in FIGS. 3-5 to the exemplary embodiment of the overall system 100 shown in more detail in FIG. 1. Specifically, FIG. 3 illustrates a configuration in which a controller 301 sends commands to one or more motors (motor A) 303*a*, (motor B) 303*b* to command movement of the slide elements 305*a*, 305*b* along respective shafts 307*a*, 307*b*, thereby moving the corresponding paddles 309*a*, 309*b* cooperatively in first directions A, or second directions B, respectively in opposition to one another during a tamping process. In this example, the tamping motors 303*a*, 303*b* may cause the slide elements 305*a*, 305*b* to move away from (direction A) or toward (direction B) each other (and the centerline of the ejection direction 123—see FIG. 1). Slide elements 305*a*, 305*b* may be caused to move in opposite directions toward and away from the centerline of the ejection direction such that corresponding paddles 309*a*, 309*b* also are made to move toward and away from the centerline of the ejection direction. In this example, the shafts 307*a*, 307*b* may be held substantially stationary according to a fixed structure of the overall system or may otherwise be held substantially stationary with respect to the slide elements 305*a*, 305*b* based on instructions from the controller 301 to a shaft motor (motor C) 303*c*.

It should be understood that, although depicted as multiple motors 303*a*, 303*b*, respectively controlling the movement of multiple slide elements 305*a*, 305*b*, along respective multiple shafts 307*a*, 307*b*, with their respective paddles 309*a*, 309*b* to accomplish tamping of a stack of substrates under control of the controller 301, other configurations may be employed. For example, a single motor may control the movement of slide elements 305*a*, 305*b* along the respective shafts 307*a*, 307*b*. Separately or additionally, both of the slide elements 305*a*, 305*b* may be mounted on a single shaft and move with respect one another along that single shaft.

Figure 4:
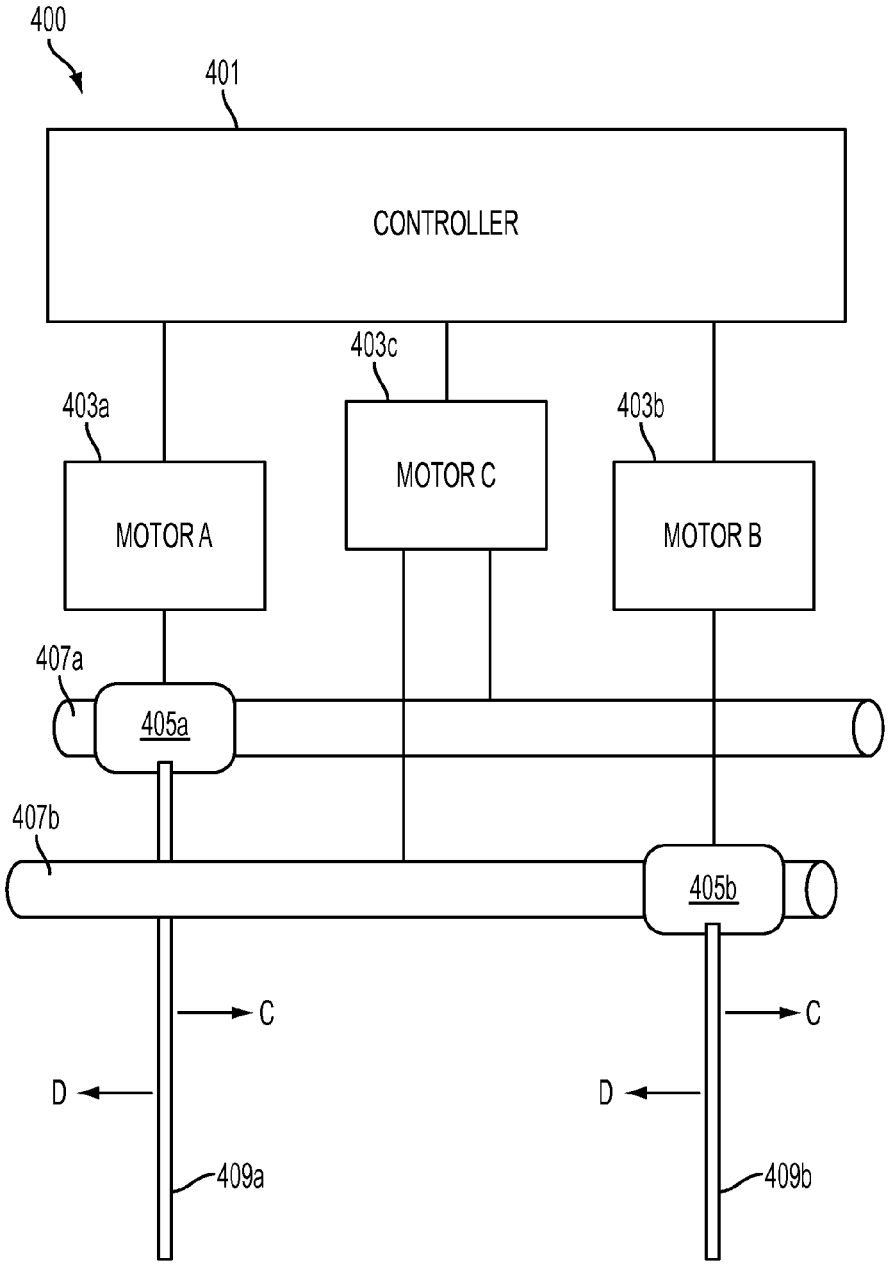
FIG. 4 illustrates a schematic diagram of a second exemplary movement of system components for laterally offsetting one or more substrates in an image forming device according to this disclosure.

FIG. 4 illustrates a schematic diagram 400 of a second exemplary movement of system components for laterally offsetting one or more substrates according to this disclosure. Specifically, FIG. 4 illustrates a configuration in which a controller 401 sends commands to one or more motors (motor A) 403*a*, (motor B) 403*b* to command movement of the slide elements 405*a*, 405*b* along respective shafts 407*a*, 407*b*, thereby moving the corresponding paddles 409*a*, 409*b* cooperatively and correspondingly in first directions C, or second directions D, during an offset process. In this example, the offset motors 403*a*, 403*b* may cause the slide elements 405*a*, 405*b* to move cooperatively with each other (and in same directions with respect to the centerline of the ejection direction 123—see FIG. 1). Slide elements 405*a*, 405*b* may be caused to move in the same direction during the offset process, such that corresponding paddles 409*a*, 409*b* also move cooperatively with each other so as to cause one or more sheets of substrate, as discussed above, to be laterally offset in a single direction from the centerline of the ejection direction. In this example, the shafts 407*a*, 407*b* may be held substantially stationary according to fixed structural components of the overall system or may otherwise be held substantially stationary with respect to the slide elements 405*a*, 405*b* on instructions from the controller 401 to the shaft motor (motor C) 403*c*.

As noted above with respect to FIG. 3, it should be understood that, although depicted as multiple motors 403*a*, 403*b*, respectively controlling the movement of multiple slide elements 405*a*, 405*b*, along respective multiple shafts 407*a*, 407*b*, with their respective paddles 409*a*, 409*b* to accomplish lateral offset of substrates under control of the controller 401, other configurations may be employed. For example, a single motor may control the movement of slide elements 405*a*, 405*b* along the respective shafts 407*a*, 407*b*. Separately or additionally, both of the slide elements 405*a*, 405*b* may be mounted on a single shaft and move in a same direction with respect to one another along that single shaft.

Figure 5:
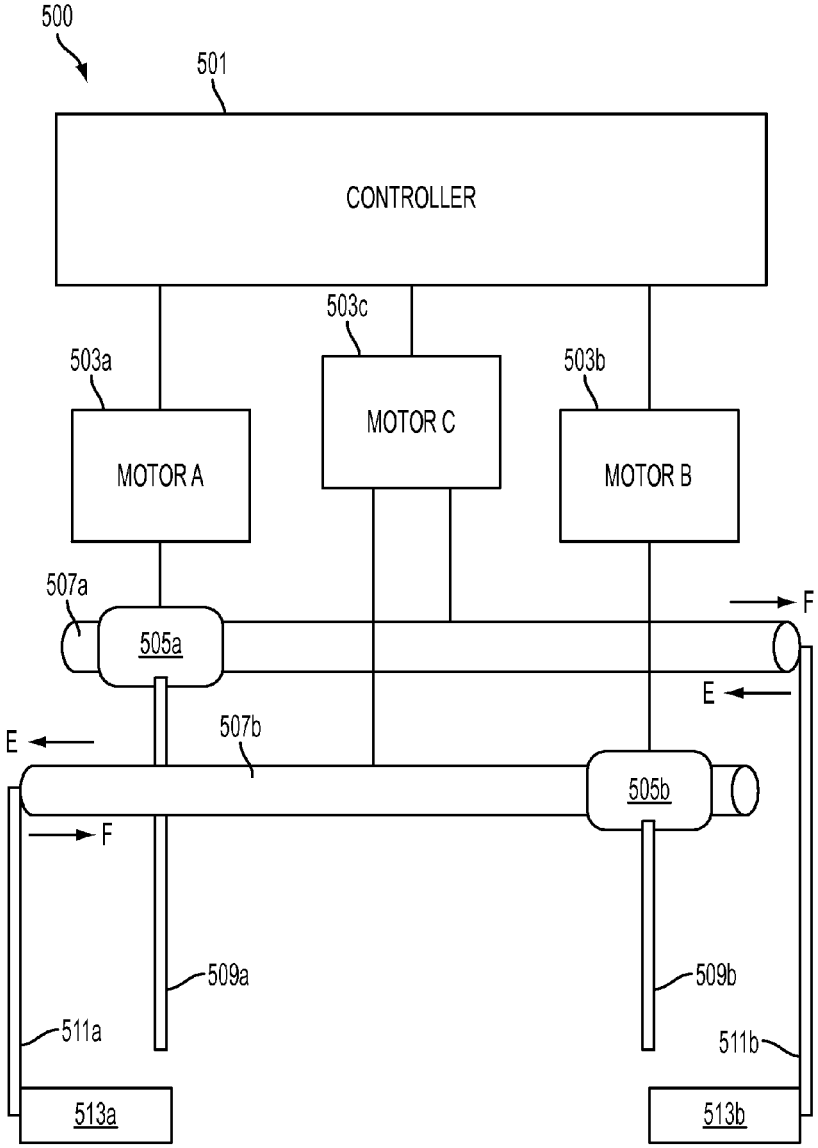
FIG. 5 illustrates a schematic diagram of a third exemplary movement of system components for actuating another mechanism useful in printing in an image forming device according to this disclosure.

FIG. 5 illustrates a schematic diagram 500 of a third exemplary movement of system components for actuating another mechanism useful in printing according to this disclosure. Specifically, FIG. 5 illustrates a configuration in which a controller 501 sends commands to a shaft motor (motor C) 503*c* to command movement of the shafts 507*a*, 507*b* cooperatively or separately in first directions E or second directions F to drive the corresponding levers 511*a*, 511*b* in a manner so as to translate shaft movement to drive actuators 513*a*, 513*b* during a mechanism actuation process. In this example, the shaft motor 503*c* may cause one or the other or both of the shafts 507*a*, 507*b* to move in a manner that moves the levers 511*a*, 511*b* laterally or around a fulcrum so as to translate movement of the levers 511*a*, 511*b* to the actuators 513*a*, 513*b*. Shafts 507*a*, 507*b* are caused to move in axial directions such that corresponding levers 511*a*, 511*b* may be actuated thereby causing respectively associated actuators 513*a*, 513*b* to move from an engaged position to a disengaged position with, for example, a tray to facilitate attachment and removal of the tray to and from the system 100 on demand. In this example, the slide elements 505*a*, 505*b* and the respective paddles 509*a*, 509*b* may be held substantially stationary with respect to the shafts 507*a*, 507*b* on instructions from the controller 501 to the slide element motors, (motor A) 503*a* and (motor B) 503*b*.

In a similar manner to that noted above with respect to FIGS. 3 and 4, it should be understood that, although depicted as a single motor 503*c* controlling the movement of multiple shafts 507*a*, 507*b* to accomplish the actuation of multiple actuators 513*a*, 513*b*, via multiple levers 511*a*, 511*b* under control of the controller 501, other configurations may be employed. For example, multiple motors may control the movement of the respective shafts 507*a*, 507*b*. Separately or additionally, a single shaft may be employed to actuate a single lever and actuator combination or to sequentially activate the pair of lever/actuator combinations. Finally, one or both of the actuators 513*a*, 513*b* may be placed directly in mechanical or operational contact with one or both of the shafts 507*a*, 507*b*, doing away with one or both of intervening levers 511*a*, 511*b*.

The disclosed processes may be advantageously implemented via software, hardware, firmware or a combination of these. For example, the disclosed processes, may be advantageously implemented via processor(s), a Digital Signal Processing (DSP) chip, an Application Specific Integrated Circuit (ASIC), Field Programmable Gate Arrays (FPGAs), and other like devices, components, processors and/or circuits. Such exemplary control and processing elements for performing the described functions are detailed further below.

FIG. 6 is an exemplary block diagram of a control system 600, which may include, or comprise, a chip set, that can be used to implement a control scheme according to this disclosure. Control system 600 may be programmed to implement control of a plurality of substrate handling functions in an image forming device, including tamping a stack of substrates, laterally offsetting a substrate, and actuating another mechanism useful in printing and may include, for example, a bus 601, a processor 603, a memory 605, a DSP 607 and an ASIC 609 component.

The processor 603 and memory 605 may be incorporated in one or more physical packages (e.g., chips). By way of example, a physical package may include an arrangement of one or more materials, components, and/or wires on a structural assembly (e.g., a baseboard) to provide one or more characteristics such as physical strength, reduction in size, and/or limitation of electrical interaction. It is contemplated that, in certain embodiments, the control system 600 can be implemented in a single chip. It is further contemplated that, in certain embodiments, the control system 600 can be implemented as a single "system on a chip." It is further contemplated that in certain embodiments a separate ASIC may not be used, for example, and that all relevant functions may be performed by a processor or processors. Control system 600, or a portion thereof, may be programmed to constitute a means for performing the plurality of functions including tamping a stack of substrates, laterally offsetting a substrate, and actuating another mechanism useful in printing.

In embodiments, the control system 600 may include a communication mechanism such as bus 601 for passing information among the components of the control system 600. Processor 603 may have connectivity to the bus 601 to execute instructions and process information stored in, for example, the memory 605. The processor 603 may include one or more processing cores with each core being configured to perform independently. A multi-core processor enables multi-processing within a single physical package. Alternatively or in addition, the processor 603 may include one or more microprocessors configured in tandem via the bus 601 to enable independent execution of instructions, pipelining, and multi-threading. The processor 603 may also be accompanied by one or more specialized components such as one or more DSPs 607, or one or more ASICs 609 to perform certain processing functions and tasks. A DSP 607 typically is configured to process real-world signals (e.g., sound) in real time independently of the processor 603. Similarly, an ASIC 609 can be configured to perform specialized functions that a more general purpose processor either could not perform, or at least could not easily perform. Other specialized components to aid in performing the described functions may include one or more FPGAs, one or more controllers, and/or one or more other special-purpose computer chips.

In embodiments, the processor (or multiple processors) 603 may perform a set of operations on information as specified by computer program code related to one or more of tamping a stack of substrates, laterally offsetting a substrate, and/or actuating another mechanism useful in printing. The computer program code may be a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations may include bringing information in from the bus 601 and placing information on the bus 601.

The processor 603 and accompanying components may have connectivity to the memory 605 via the bus 601. The memory 605 may include one or more of dynamic memory (e.g., RAM, magnetic disk, writable optical disk, or the like) and static memory (e.g., ROM, CD-ROM, or the like) for storing executable instructions that, when executed, perform all or at least some of the disclosed steps to implement one or more of tamping a stack of substrates, laterally offsetting a substrate, and actuating another mechanism useful in printing. The memory 605 also stores the data associated with, or generated by, the execution of the steps.

In embodiments, the memory 605 stores information including processor instructions for one or more of tamping a stack of substrates, laterally offsetting a substrate, and actuating another mechanism useful in printing. Dynamic memory allows stored information to be changed by system 100. RAM allows a unit of information stored at a location called a memory address to be stored and retrieved independently of information at neighboring addresses. The memory 605 is also used by the processor 603 to store temporary values during execution of processor instructions. The memory 605 may also be a ROM or other static storage device coupled to the bus 601 for storing static information, including instructions, that is not changed by the system 100. Some memory is composed of volatile storage that loses the stored information when power is lost. The memory 605 may also include at least a non-volatile (persistent) storage portion, such as a magnetic disk, optical disk or flash card, for storing information, including instructions, that persists even when the system 100 is turned off or otherwise loses power.

The term "computer-readable medium" as used in this disclosure refers to any medium that participates in providing information to processor 603, including instructions for execution. Such a medium may take many forms, including, but not limited to, computer-readable storage media (e.g., non-volatile media, volatile media and the like), and transmission media. Non-volatile media include, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the disclosure is not so limited. Rather, it covers various obvious modifications and equivalent arrangements, which fall within the purview of the appended claims. Although features of various embodiments are expressed in certain combinations among the claims, it is contemplated that these features can be arranged in any combination and order.

Although the above description may contain specific details, they should not be construed as limiting the claims in any way. Other configurations of the described embodiments of the disclosed systems and methods are part of the scope of this disclosure. It will be appreciated that a variety of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method useful in printing comprising:

providing a substrate handling device having:

one or two shafts positioned orthogonally to a substrate ejection direction of the device, two slide elements for sliding both on the one shaft or one each on the two shafts, two substrate handling paddles associated one each with the two slide elements, a plurality of motors for (1) moving two slide elements with respect to the one or two shafts or (2) moving the one or two shafts with respect to the two slide elements, and a controller for controlling operations of the plurality of motors;

determining, with the controller, an instruction to cause an operation comprising one of a substrate tamping process, a substrate offset process, and a mechanism actuation process, the substrate tamping process including causing movement of the two slide elements with one of the plurality of motors being a tamping motor, the substrate offset process including causing movement of the two slide elements with a second one of the plurality of motors being an offset motor; and controlling, with the controller, the plurality of motors to cause a movement of one or more of the two slide elements and the one or two shafts based on the instruction, the two slide elements and the one or two shafts being configured to move in a first direction and a second direction along an axial length of the one or two shafts, movement of the one or two shafts being caused to move by a third one of the plurality of motors that is an actuator motor different from the tamping motor and the offset motor, wherein the movement in the first direction and the second direction of one or more of the two slide elements and the one or two shafts corresponds to the operation.

2. The method of claim 1, further comprising:

determining, with the controller, that the operation comprises the substrate tamping process; and controlling, with the controller, at least one of the plurality of motors to cause a first of the two slide elements to move in the first direction and a second of the two slide elements to move in the second direction in opposition to movement of the first of the two slide elements based on the determined substrate tamping process to cause the two paddles to execute the substrate tamping process.

3. The method of claim 1, further comprising:

determining, with the controller, that the operation comprises the substrate offset process; and controlling, with the controller, at least one of the plurality of motors to cause a first of the two slide elements to move in the first direction and the a second of the two slide elements to move in the first direction in coordination with movement of the first of the two slide elements based on the determined substrate offset process to cause the two paddles to execute the substrate offset process.

4. The method of claim 1, further comprising:

determining, with the controller, that the operation comprises the mechanism actuation process; and controlling, with the controller, the actuator motor to cause the one or two shafts to move in one of the first direction and the second direction based on the determined mechanism actuation process to execute the mechanism actuation process.

5. The method of claim 4, wherein the providing step includes the substrate handling device further providing at least one actuator movable between an engaged position and a disengaged position, the at least one actuator being in mechanical contact with at least of the one or two shafts, movement of the one or two shafts in one of the first direction and the second direction causing the at least one actuator to be moved between the engaged position and the disengaged position.

6. The method of claim 5, further comprising controlling, with the controller, the actuator motor to cause the one or two shafts to move in a manner that, in turn, causes the at least one actuator to move between the engaged position and the disengaged position.

7. The method of claim 6, wherein the providing step provides the mechanical contact with an actuating lever interposed between the one or two shafts and the at least one actuator, movement of the one or two shafts by the at least one motor moving the actuating lever to move the at least one actuator between the engaged position and the disengaged position.

8. The method of claim 7, further comprising enabling at least one of attachment of a tray to, detachment of the tray from or movement of the tray with respect to, the substrate handling device by the movement of the at least one actuator between the engaged position and the disengaged position.

9. An apparatus useful in printing comprising:

one or two shafts positioned orthogonally to a substrate ejection direction of the apparatus;

two slide elements for sliding both on the one shaft or one each on the two shafts;

two substrate handling paddles associated one each with the two slide elements;

a plurality of motors for (1) moving two slide elements with respect to the one or two shafts or (2) moving the one or two shafts with respect to the two slide elements; and at least one processor, the at least one processor being programmed to:

determine an instruction to cause an operation comprising one of a substrate tamping process, a substrate offset process, and a mechanism actuation process, the substrate tamping process including causing movement of the two slide elements with one of the plurality of motors being a tamping motor, the substrate oft set process including causing movement of the two slide elements with a second one of the plurality of motors being an offset motor; and control the plurality of motors to cause a movement of one or more of the two slide elements and the one or two shafts based on the instruction, the two slide elements and the one or two shafts being configured to move in a first direction and a second direction along an axial length of the one or two shafts movement of the one or two shafts being caused to move by a third one of the plurality of motors that is an actuator motor different from the tamping motor and the offset motor, wherein the movement in the first direction and the second direction of one or more of the two slide elements and the one or two shafts corresponds to the operation.

10. The apparatus of claim 9, the processor being further programmed to:

determine that the operation comprises the substrate tamping process; and control at least one of the plurality of motors to cause a first of the two slide elements to move in the first direction and a second of the two slide elements to move in the second direction in opposition to movement of the first of the two slide elements based on the determined substrate tamping process to cause the two paddles to execute the substrate tamping process.

11. The apparatus of claim 9, the processor being further programmed to:

determine that the operation comprises the substrate offset process; and control at least one of the plurality of motors to cause a first of the two slide elements to move in the first direction and a second of the two slide elements to move in the first direction in coordination with movement of the first of the two slide elements based on the determined substrate offset process to cause the two paddles to execute the substrate offset process.

12. The apparatus of claim 9, the processor being further programmed to:

determine that the operation comprises the mechanism actuation process; and control the actuator motor to cause the one or two shafts to move in one of the first direction and the second direction based on the determined mechanism actuation process to execute the mechanism actuation process.

13. The apparatus of claim 12, further comprising at least one actuator movable between an engaged position and a disengaged position, the at least one actuator being in mechanical contact with at least one of the one or two shafts, movement of the one or two shafts in one of the first direction and the second direction causing the at least one actuator to be moved between the engaged position and the disengaged position.

14. The apparatus of claim 13, the processor being further programmed to control the actuator motor to cause the one or two shafts to move in a manner that, in turn, causes the at least one actuator to move between the engaged position and the disengaged position.

15. The apparatus of claim 14, the apparatus further comprising an actuating lever interposed between the one or two shafts and the at least one actuator, movement of the one or two shafts by the actuator motor moving the actuating lever to move the at least one actuator between the engaged position and the disengaged position.

16. The apparatus of claim 15, the movement of the at least one actuator between the engaged position and the disengaged position enabling at least one of attachment of a tray to, detachment of the tray from or movement of the tray with respect to, the substrate handling device.

* * * * *